US006490750B2

(12) United States Patent
Shia et al.

(10) Patent No.: US 6,490,750 B2
(45) Date of Patent: Dec. 10, 2002

(54) POWER BRUSH

(75) Inventors: Chih-yuan Shia, Germantown; James A. Henderson, Greenfield, both of WI (US)

(73) Assignee: PFERD Milwaukee Brush Company Inc., Menomonee Falls, WI (US)

( * ) Notice: Subject to any disclaimer, the term of this patent is extended or adjusted under 35 U.S.C. 154(b) by 0 days.

(21) Appl. No.: 09/953,134

(22) Filed: Sep. 17, 2001

(65) Prior Publication Data

US 2002/0045416 A1 Apr. 18, 2002

Related U.S. Application Data

(60) Provisional application No. 60/239,891, filed on Oct. 13, 2000.

(51) Int. Cl.[7] ..... A46B 7/08

(52) U.S. Cl. ..... 15/179; 15/230; 15/230.17

(58) Field of Search ..... 15/179, 180, 230, 15/230.12, 230.14, 230.15, 230.16, 230.17, 230.19; 51/59; 242/600, 607, 608, 608.2, 608.7, 614

(56) References Cited

U.S. PATENT DOCUMENTS

| | | | | |
|---|---|---|---|---|
| 680,418 | A | * | 8/1901 | Ross |
| 863,790 | A | | 8/1907 | Dixon |
| 988,506 | A | | 4/1911 | Radinse |
| 1,125,153 | A | * | 1/1915 | Nielson |
| 1,270,614 | A | * | 6/1918 | Harmon |
| 1,306,881 | A | * | 6/1919 | Chamberlin |
| 1,323,969 | A | * | 12/1919 | Dilg |
| 1,326,372 | A | | 12/1919 | Radinse |
| 1,469,018 | A | * | 9/1923 | Nielson |
| 1,584,835 | A | | 5/1926 | Blanch |
| 1,683,456 | A | | 9/1928 | Frost |
| 1,885,706 | A | | 11/1932 | Frost |
| 1,920,667 | A | | 8/1933 | Radinse |
| 2,000,612 | A | | 5/1935 | Radinse |
| 2,660,841 | A | * | 12/1953 | Leslie |
| 3,239,276 | A | * | 3/1966 | Charvat |
| 3,289,234 | A | * | 12/1966 | Nelson |
| 3,307,213 | A | | 3/1967 | Schofield ..... 15/179 |
| 3,380,098 | A | | 4/1968 | Nelson ..... 15/179 |
| 5,323,505 | A | | 6/1994 | Mantabaur et al. ..... 15/179 |

OTHER PUBLICATIONS

Advance Brush catalog, Pferd Milwaukee Brush Co. Inc., 1998.

* cited by examiner

*Primary Examiner*—Terrence R. Till
(74) *Attorney, Agent, or Firm*—Pennie & Edmonds LLP

(57) ABSTRACT

A hub is disclosed for supporting and retaining at least one surface conditioning article relative to and spaced apart from a rotary shaft. The hub may be a hub of a brush assembly. The hub includes an arbor tube and a pair of plates. Shoulders are provided on the arbor tube and the plates are coupled to the arbor tube at a pre-determined distance set by shoulders. The surface conditioning article is provided between the plates. Since the distance between the plates is set by the shoulders, the density of the surface conditioning article between the face plates also is predetermined. The plates may include a key-shaped region with a circular portion and a keyseat. An adapter also may be provided. The adapter is configured and dimensioned to be engaged in the key-shaped region, permitting a shaft having a smaller diameter to be coupled to the hub.

22 Claims, 8 Drawing Sheets

POWER BRUSH

CROSS-REFERENCE TO RELATED APPLICATIONS

The benefit of Provisional Application No. 60/239,891 filed Oct. 13, 2000 is claimed under 35 U.S.C. §119(e).

TECHNICAL FIELD

The present invention relates generally to improved brushes used for surface conditioning. More specifically, the present invention relates to a power brush having an improved tube assembly system. The present invention also relates to an improved power brush adapter that permits the power brush to accommodate a variety of mounting shaft sizes and also permits the shaft to provide positive transmission of torque to the power brush.

BACKGROUND OF THE INVENTION

High speed rotary brushing is well known as a means for surface conditioning, particularly for metallic objects, and is suitable in a diverse array of applications in areas such as the automotive, farm, and hardware industries. Brushing is an effective technique for cleaning a surface, altering a surface finish, and limited material removal. Brushing permits surface roughening as well as surface smoothing as for deburring or radiusing. The use of a rotary power brush on an object results in a surface with generally uniform scratches, and this surface finish is often acceptable for a given application. Objects that require a scratch-free surface may be subjected to a variety of secondary polishing operations in order to achieve the desired surface finish, such as buffing the object with a cloth wheel charged with a polishing rouge. Brushing is typically accomplished by manually bringing a workpiece in contact with the rotating power brush, or conversely by bringing the power brush in contact with the workpiece. In more sophisticated operations, the brushing task may be automated.

Brush construction features can directly impact the expected brush service life and performance level. Generally, the more rigid and structurally solid a power brush is constructed, the finer the surface finish and the longer the service life of the power brush. A dynamically-balanced power brush assembly transmits less vibration to the equipment and the workpiece, thereby providing enhanced performance.

An important design consideration for a rotary power brush is the choice of central hub construction. Because power brushes generate heat during operation, effective means for heat dissipation must be provided. Metal hub assemblies, which have large contact areas with the mounting shaft, permit thermal conduction from the power brush through the hub and mounting shaft, facilitating heat dissipation.

Filament density, or the number of working filament tips per unit area (commonly referred to as points per square inch), impacts performance as well. Increasing brush filament density results in a finer, more uniform surface finish. A denser-filled brush is more aggressive to the work-piece due to reduced filament flexibility as well as increased working points in contact with the surface per brush revolution. Increased brush filament density also provides longer brush life. Brush filament density can be increased by adding more fill material to an existing design or by reducing the ratio of brush section outside diameter to brush section inside diameter. Brushes having smaller individual filament diameters tend to follow the contours of the workpiece more closely and to produce a more uniform surface, whereas as the density of filaments increases, the brush loses some of its ability to follow contours. Finer diameter filaments are less aggressive toward the workpiece and may result in longer cycle times.

The modern approach to designing and manufacturing power brushes typically involves combining individual, narrow sections together to form a wider face width, thereby producing a generally consistent brush filament density over a large area. Typically, power brushes are formed by mounting a plurality of brush sections on an arbor tube and then mounting a face plate at each end of the arbor tube to maintain the brush sections therebetween. Each brush section is formed by wrapping the brush filaments (e.g., wires) about a retaining ring (which may resemble a washer). The filaments are typically held in place about the retaining ring by friction, such as through the use of an eyelet, so that welding or use of adhesives is not necessary. Once the face plates are positioned at each end of the arbor tube, surrounding the brush sections, the ends of the arbor tube are flanged over the face plates, such as through the use of a hydraulic press which cold-works the material, to secure the face plates in place on the arbor tube. But, internal friction between the component parts and minor variations in section thickness result in a finished power brush assembly with an overall thickness that varies with each power brush produced. In particular, the brush sections are not necessarily brought together in a uniform manner from finished brush to finished brush. Thus, although the number of filaments on each retaining ring typically is set, and the number of brush sections mounted on the arbor tube is set, the stacking of the brush sections against one another and the distance between the face plates is not readily controllable. Accordingly, the packing of the brush sections, and hence the density of the brush filaments of the finished power brush may vary from brush to brush. Thickness variations on the order of 75 to 100 thousandths of an inch may occur potentially resulting in uneven cleaning action may be imparted to a workpiece due to the variation in brush packing.

While the above-described rotary power brush developments permit a rotary power brush to be produced with a reliable construction, it is desirable to manufacture an improved rotary power brush with a structure that provides a more consistent brush filament density.

Certain operating factors also can significantly impact brushing quality and service life. In particular, a more secure connection of the power brush to the drive shaft results in a better surface finish, longer brush service life, and reduced vibration and chatter which cause surface imperfections. Furthermore, by minimizing relative motion between the internal components of the power brush, decreased component wear and degradation are realized.

In rotating machinery, torque may be transmitted from shafts to coupling hubs (or vice versa) through keys, friction, or a combination thereof. A solid connection must be maintained between the driving and the driven components in such a mechanical power transmission system in order to achieve satisfactory performance. Because keyed designs typically are not used in power brush equipment, a relatively tight fit is desirable to achieve frictional engagement to drive the power brush. A true interference fit would contribute to the transmission of torque and also would help to prevent the hub from rocking on the shaft. However, a tight interference fit is not desirable because of the difficulty users experience with changing or removing power brushes from shafts. Thus, coupling hubs, such as arbor tubes, instead are generally installed on shafts with a small amount of clearance to facilitate installation and removal. To secure the power brush on the drive shaft more securely and to prevent relative rotation, a drive flange is clamped on either side of the power brush to engage the face plates of the power brush frictionally so that the power brush may be driven by friction. Such clamping further maintains a secure connection between the power brush and the associated shaft, particularly because keyed systems have not been used between the shaft and arbor tube.

An example of suitable means for holding and centering grinding and polishing wheels or the like on a drive shaft is disclosed in U.S. Pat. No. 1,584,835 to Sven Blanch. The grinding wheels include a central ring that has a passage therethrough which is larger than any arbor on which it is likely to be placed. To center the wheels on arbor tubes of different diameters, a set of two sheet metal discs of the same size is provided, with one disc fitting on each side of the passage through the central ring. Each disc is provided with an annular projection having a cylindrical shoulder that fits the inner wall of the passage through the central ring. The discs also include a central cylindrical wall that forms a bearing for the arbor tube. Sets of discs with different passage diameters permit any wheel to be put on any arbor by selecting the proper pair of discs. Although the discs accommodate a variety of shaft sizes, the discs do not ensure positive torque transmission from the shaft to the disc, and from the disc to the central ring of the wheel assembly.

Modem power brushes are typically provided with an arbor hole of 2 inches in diameter, thereby accommodating shafts with a 2 inch outer diameter. Some power brush assemblies, however, may even include arbor holes of 5 inches or larger in outer diameter. In order to use these power brushes with smaller-sized shafts, adapters may be inserted into the arbor holes. The adapters can permit an operator to use the power brush with shafts that range in size, for example, from ⅜ inch to 1¾ inches. One pair of adapters is typically required, with an adapter fitted in either side of the arbor hole.

It therefore would be desirable to provide a brush assembly with a rigid construction and mounting, and a carefully fabricated central hub through which shafts are passed. In addition, it would be desirable to establish a more secure connection of the hub of a power brush assembly to a rotating drive shaft. This is particularly challenging in light of the variety of shaft sizes typically used. It would be desirable to provide a more secure engagement for adapters than currently achieved by frictional engagement. In particular, it would be desirable to achieve a reliable, positive torque transmission from the shaft to the adapter to the central hub of the power brush assembly. Furthermore, it would be desirable to form a power brush assembly which permits the various adapters presently available to fit into the cylindrical arbor hole of the power brush assembly by positive mechanical interlocking.

SUMMARY OF THE INVENTION

In accordance with the principles of the present invention, a hub for supporting and retaining at least one surface conditioning article relative to and spaced apart from a rotary shaft is provided. The hub includes an arbor tube having first and second ends, and a pair of face plates each having an inner rim with a top surface and a bottom surface. The arbor tube includes a pair of opposing shoulders, with a shoulder being disposed at each end of the arbor tube. The face plates are coupled to the first and second ends of the arbor tube such that the bottom surface of the inner rim abuts the shoulders, and the face plates are thus maintained at a set distance apart by the shoulders. The hub further includes brush filaments disposed radially about the outer surface of the arbor tube. When the face plates are coupled to the arbor tube with the bottom surface of each inner rim abutting a shoulder of the arbor tube, the filaments have a substantially uniform filament density between the face plates.

The arbor tube may also include a pair of extensions, with each extension extending away from a respective shoulder, and with the face plates mounted on a respective extension. The extensions may be deformed to abut respective top surfaces of the face plates to couple the face plates to the arbor tube. At least one of the face plates may include at least one spike, and the shoulders of the arbor tube may include chamfered portions.

The present invention is also directed to a power brush assembly with brush filaments mounted on an arbor tube and between face plates. The brush filament density is determined by the distance of the face plates from each other, as set by the distance of shoulders provided on the arbor tube. In a preferred embodiment, the brush filaments are formed as a plurality of separate brush sections, each brush section including a retaining ring and a plurality of filaments around the retaining ring. Spacing between the brush sections is set by the distance between the shoulders and the resulting set distance between the face plates. At least one of the face plates may include at least one spike biting into the brush filaments.

Another aspect of the present invention is the formation of a power brush hub with an arbor tube having first and second ends and a pair of opposing locking plates, a locking plate being mounted on each end of the arbor tube. A key-shaped region is defined in each of the locking plates, the key-shaped region having at least a circular portion and a keyseat. A pair of opposing keyseats may be provided in each key-shaped region, and the keyseat may be a rectangular groove. A lip also may be provided in the circular portion of the key-shaped region. Such configuration permits a shaft to positively transmit torque to the locking plate via a key and keyseat system, rather than simply frictional engagement of drive flanges on face plates of the power brush.

In a preferred embodiment, at least one adapter, configured and dimensioned to be engaged in the key-shaped region of the locking plate, is provided. The adapter includes an outwardly extending key shaped to engage within the keyseat of the key-shaped region of the locking plate. If desired, a pair of opposing keyseats may be provided within the key-shaped region of the locking plate, and the adapter may include a corresponding pair of opposing outwardly extending keys shaped to engage within the keyseats of the locking plate key-shaped region. An adapter key-shaped region may be defined in the adapter, shaped to accommodate a shaft smaller in diameter than the locking plate key-shaped region and keys mounted on the shaft.

Yet another aspect of the present invention is a method for positively driving a power brush, the method including: providing a hub comprising an arbor tube having first and second ends and a locking plate mounted on each end, at least one of the locking plates having at least one key-shaped region having at least a circular portion and a plate keyseat; providing a rotary shaft, the shaft having at least one shaft keyseat; and inserting a key in the shaft keyseat and the locking plate keyseat, thereby coupling the shaft to the hub. The locking plate may be adapted for mounting on a drive shaft having a smaller shaft diameter than the circular portion of the key-shaped region of the locking plate by using an adapter in the key-shaped region. The adapter includes an adapter key-shaped region having at least a circular portion and an adapter keyseat. A key inserted in the shaft keyseat and the adapter keyseat couples the shaft to the adapter.

These and other features and advantages of the present invention will be readily apparent from the following detailed description of the invention, the scope of the invention being set out in the appended claims.

BRIEF DESCRIPTION OF THE DRAWINGS

The invention will be better understood from the following detailed description of an exemplary embodiment thereof in conjunction with the accompanying drawings in which.

DETAILED DESCRIPTION OF THE INVENTION

Figure 1:
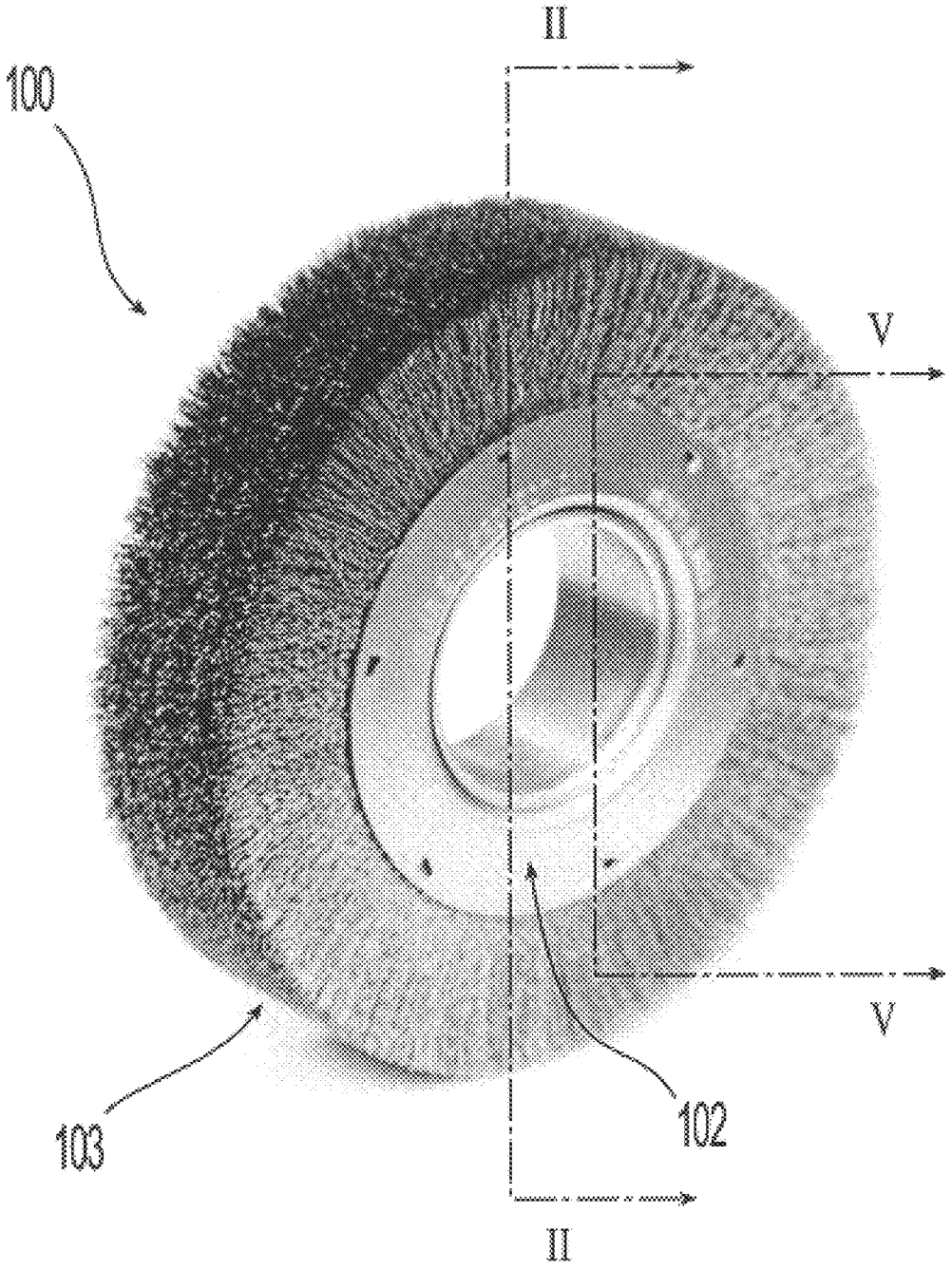
FIG. 1 is a perspective view of a power brush assembly in accordance with the principles of the present invention.

Referring to FIGS. 1–6, there is shown an exemplary brush assembly 100 formed in accordance with the principles of the present invention. Assembly 100 includes hub 102 and brush filaments 103. It will be appreciated that any surface conditioning article may be used instead of brush filaments while still benefitting from the principles of the present invention. In the embodiment of FIGS. 1–6, brush assembly 100 is formed by mounting brush sections (as described above) over arbor tube 108 and then mounting a pair of face plates 104, 106 on the ends 107, 109 of arbor tube 108, thus surrounding and securing the brush sections on arbor tube 108. As will be explained in detail herein, the provision of shoulders on arbor tube 108 advantageously permits face plates 104, 106 to be precisely spaced with respect to each other. Thus, while the spacing of filament retaining components on prior art brush assemblies has been governed by the presence of the filaments themselves, in the present development the shoulders provided on the arbor tube—not the brush filaments—establish the spacing between face plates 104, 106. Accordingly, a constant distance between face plates 104, 106 may be set, thereby setting a substantially constant brush filament density (or density of another type of surface conditioning article positioned between face plates 104, 106).

Figure 2:
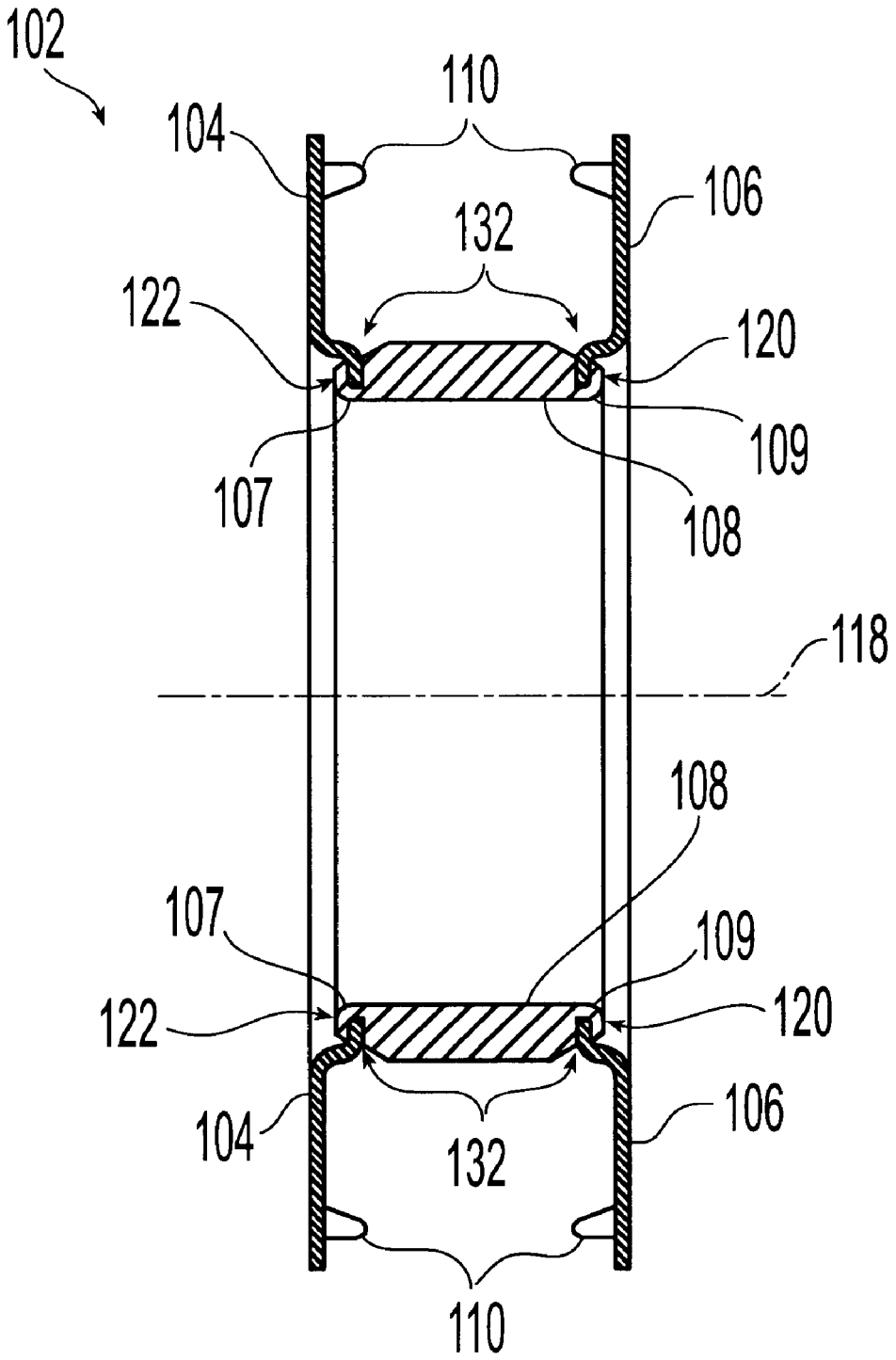
FIG. 2 is a cross-sectional view along line II—II of the power brush assembly of FIG. 1 with the brush filaments omitted for the sake of simplicity.
Figure 3:
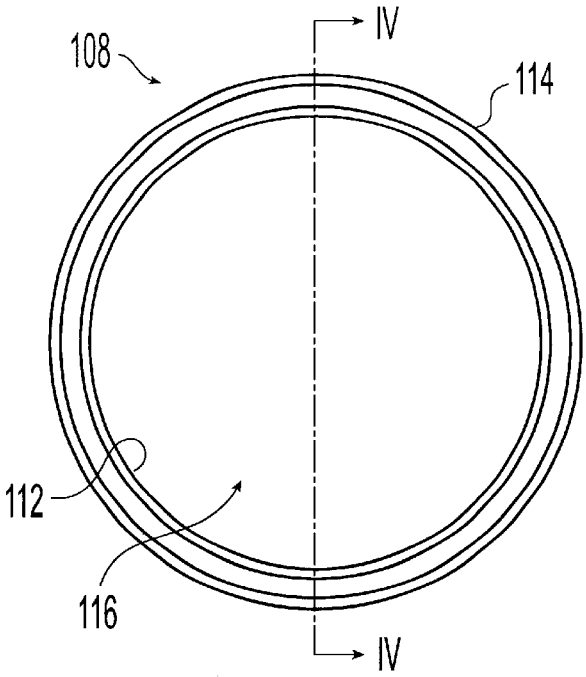
FIG. 3 is an elevational view of an arbor tube which may be used in the power brush assembly of FIG. 1.
Figure 4:
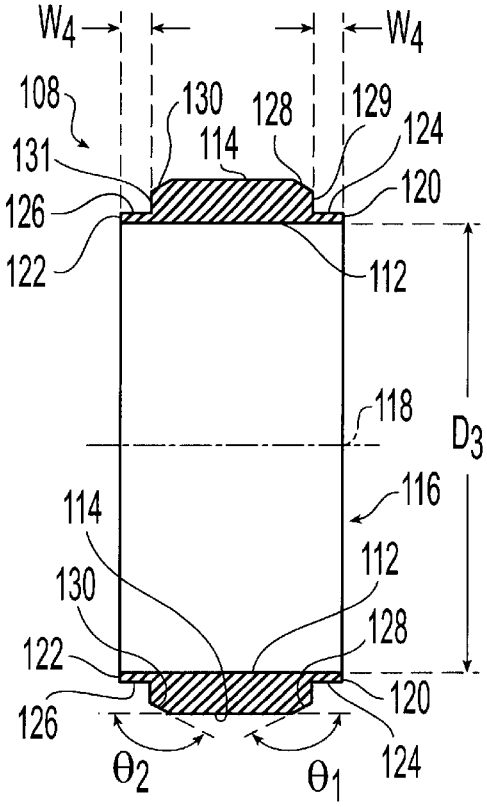
FIG. 4 is a cross—sectional view along line IV—IV of the arbor tube of FIG. 3.

As further shown in FIG. 3, an arbor tube 108 has an inner surface 112 and an outer surface 114. A bore 116 having an axis 118 is defined within arbor tube 108, extending between first end 107 and second end 109. Bore 116 is configured to receive a rotary drive shaft (not shown) to drive power brush assembly 100. Preferably, arbor tube 108 is substantially symmetrical about axis 118, and inner surface 112 is free of burrs and sharp edges. Extensions 124, 126 may be provided in the vicinity of first and second ends 107, 109, respectively, of arbor tube 108 for securing face plates 104, 106 on arbor tube 108, as will be explained shortly. Outer surface 114 of arbor tube 108 may also include chamfered portions 128, 130 formed at chamfer angles $\theta_1$,$\theta_2$ respectively. Preferably, chamfer angles $\theta_1$,$\theta_2$ are equal and may be about 150°. When face plates 104, 106 are secured to arbor tube 108, chamfered portions 128, 130 of arbor tube 108 abut the inside surface of face plates 104, 106 to form V-shaped notches 132, as illustrated in FIG. 2. Chamfered portions 128, 130 each provide a lead angle for the assembly of the brush sections onto arbor tube 108. The use of a lead angle facilitates assembly such that potential damage to the brush sections may be minimized. In addition, chamfered portions 128, 130 facilitate surface-to-surface contact between arbor tube 108 and face plates 104, 106, promoting mechanical stability of the connection. A brush assembly having an arbor tube without chamfered edges may be mechanically unstable in construction if burrs or other irregularities are present near the interface between the arbor tube and the face plates, as such irregularities may alter the assembled width of the brush assembly from the intended dimensions.

Walls 129, 131 form opposing shoulders on arbor tube 108 against which face plates 104, 106 abut. Because these shoulders are typically machined, the distance between the shoulders may be set at a high tolerance. Moreover, because face plates 104, 106 abut the shoulders formed by walls 129, 131, the distance between face plates 104, 106 is set by the distance between walls 129, 131. Thus, assemblies of arbor tube 108 and face plates 104, 106 mounted thereon are consistently dimensioned from one assembly to the next, with a predetermined, set distance between the face plates 104, 106, as mounted on the arbor tube 108. As a result, because these components abut each other in a dimensionally predictable manner, and because the distance between face plates 104, 106 is predictable and substantially constant from one assembly to the next, packing of filaments between face plates 104, 106 is consistent from one assembly to the next and a brush assembly with a constant filament density can be produced.

Figure 5:
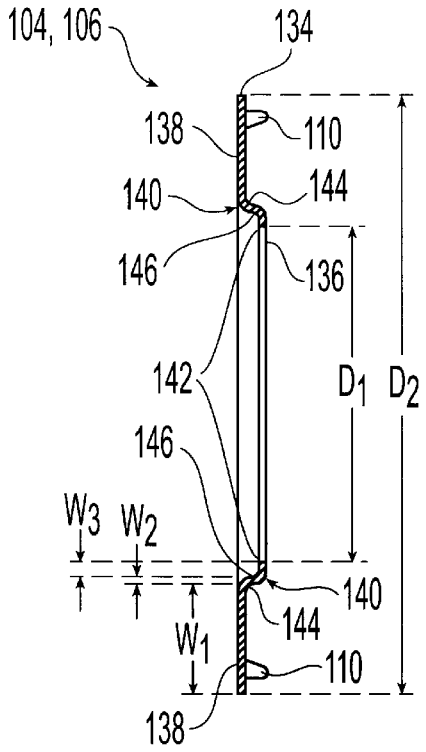
FIG. 5 is a cross—sectional view along line V—V of a face plate used in the power brush assembly of FIG. 1, shown in isolation.
Figure 6:
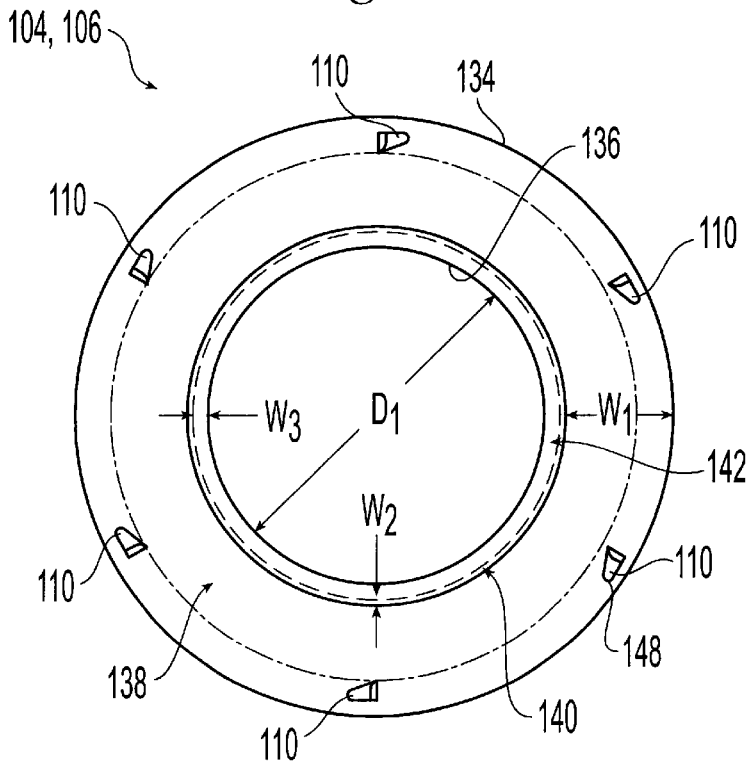
FIG. 6 is an elevational view of the face plate of FIG. 5.

With reference to FIGS. 5 and 6, face plates 104, 106 are circular and have outer and inner rims 134, 136 respectively. Inner rim 136 has an inner diameter $D_1$, while outer rim 134 has an outer diameter $D_2$. Each face plate 104, 106 includes a peripheral annular portion 138, a transition annular portion 140, and a central annular portion 142, the annular regions having overall widths $W_1$, $W_2$, $W_3$ respectively. Peripheral and central annular portions 138 and 142 may be configured to lie in substantially parallel planes with transition annular portion 140 joining portions 138 and 142. Transition annular portions 140 of face plates 104, 106 preferably have an S-shaped or inverted S-shaped profile, such that inner and outer arcuate portions 144, 146 are provided. By avoiding sharp edges, stress concentration is avoided, improving the reliability, durability, and service life of the product. Arcuate portions 144, 146 preferably have maximum radii of curvature of about 0.13 centimeter and 0.07 centimeter, respectively.

Face plates 104, 106 have the above-mentioned configuration in order to facilitate mounting on extensions 124, 126. Inner rim 136 is configured and dimensioned to be fitted over extensions 124, 126 of arbor tube 108. Face plates 104, 106 may be provided with a small amount of clearance to facilitate smooth mounting on arbor tube 108 and thus rapid assembly, although a slight interference fit may instead be provided. Alternatively, a more extensive press fit may be used as an additional means of securing face plates 104, 106 to arbor tube 108. Preferably, central annular portion 142 of each face plate 104, 106 has a width $W_3$ that is sufficiently large to permit adequate coupling of a face plate 104, 106 to the arbor tube 108. The shoulders of arbor tube 108 are also adequately dimensioned to effect a secure coupling between the face plate and the arbor tube. Thus, when arbor tube 108 is seated within inner rim 136 of a face plate 104, 106, a portion of an extension 124, 126 of arbor tube 108 projects beyond inner rim 136. Arbor tube 108 and face plates 104, 106 are coupled together by any desired manner familiar to those of skill in the art to form hub 102. For instance, to secure a face plate 104, 106 on arbor tube 108, a side 120, 122, such as extensions 124, 126, of arbor tube 108 may be flanged and bent over the face plates 104, 106 to mechanically couple face plates 104, 106 to arbor tube 108. A portion of arbor tube 108 or extensions 124, 126 would remain unflanged to serve as a seat for face plates 104, 106. Bending of extensions 124, 126 of arbor tube 108 may be accomplished by using a hydraulic press with a tool that applies a force to arbor tube 108 at an appropriate angle, such as at approximately a 45 degree angle. Although extensions 124, 126 may be cold-worked to form a mechanical connection of face plates 104, 106 to arbor tube 108, other manners of coupling may be used, as known to those of skill in the art.

With the above-described assembly, welding or adhesives are not necessary to create a secure hub 102 that provides a consistent brush filament density. The shoulders on arbor tube 108 permit a predetermined distance to be established between face plates 104, 106, and thus a predetermined brush filament density may be provided with minimal variation in the vicinity of face plates 104, 106. Such a construction of brush assembly 100 further permits consistent brush quality during use, thereby allowing a more consistent work product to be produced.

Hub 102 may be provided with spikes 110, formed such as by being stamped from face plates 104, 106, which bite into brush filaments 103 (not illustrated). As shown in FIG. 6, optional spikes 110 may be equally spaced about the periphery of face plates 104, 106. For example, six spikes maybe provided, with adjacent spikes 110 separated by about 60 degrees with respect to axis 118. Slightly rounded ends 148 may be provided on spikes 110. Furthermore, spikes 110 are typically configured and dimensioned to provide significant surface area to abut brush filaments 103, so that the movement of brush filaments 103 with respect to each other may be further constrained. For example, spikes 110 have a width of about ⅛ inch and have a length that protrudes more than ⅛ inch into brush filaments 103. Alternatively, other means may be employed to provide additional brush filament constraint.

As will be appreciated, inventive brush assembly 100 thus significantly reduces the dimensional variations encountered with prior art brush assembly designs during manufacture. Because walls 129, 131 of arbor tube 108 are typically machined surfaces formed to a known, repeatable dimension, i.e., consistent within a few thousandths of an inch from one arbor tube to the next, the density of brush filaments in the finished brush assembly is constant. The high precision of the power brush assemblies of the present invention is particularly apparent when compared to prior art brush assemblies that may have thickness variations on the order of 75 to 100 thousandths of an inch. Because high precision surfaces govern the critical dimensions of the brush assembly, and a press-fit does not control the spatial relation of the critical components with respect to one another, a brush assembly with a constant filament density can be produced.

Figure 7:
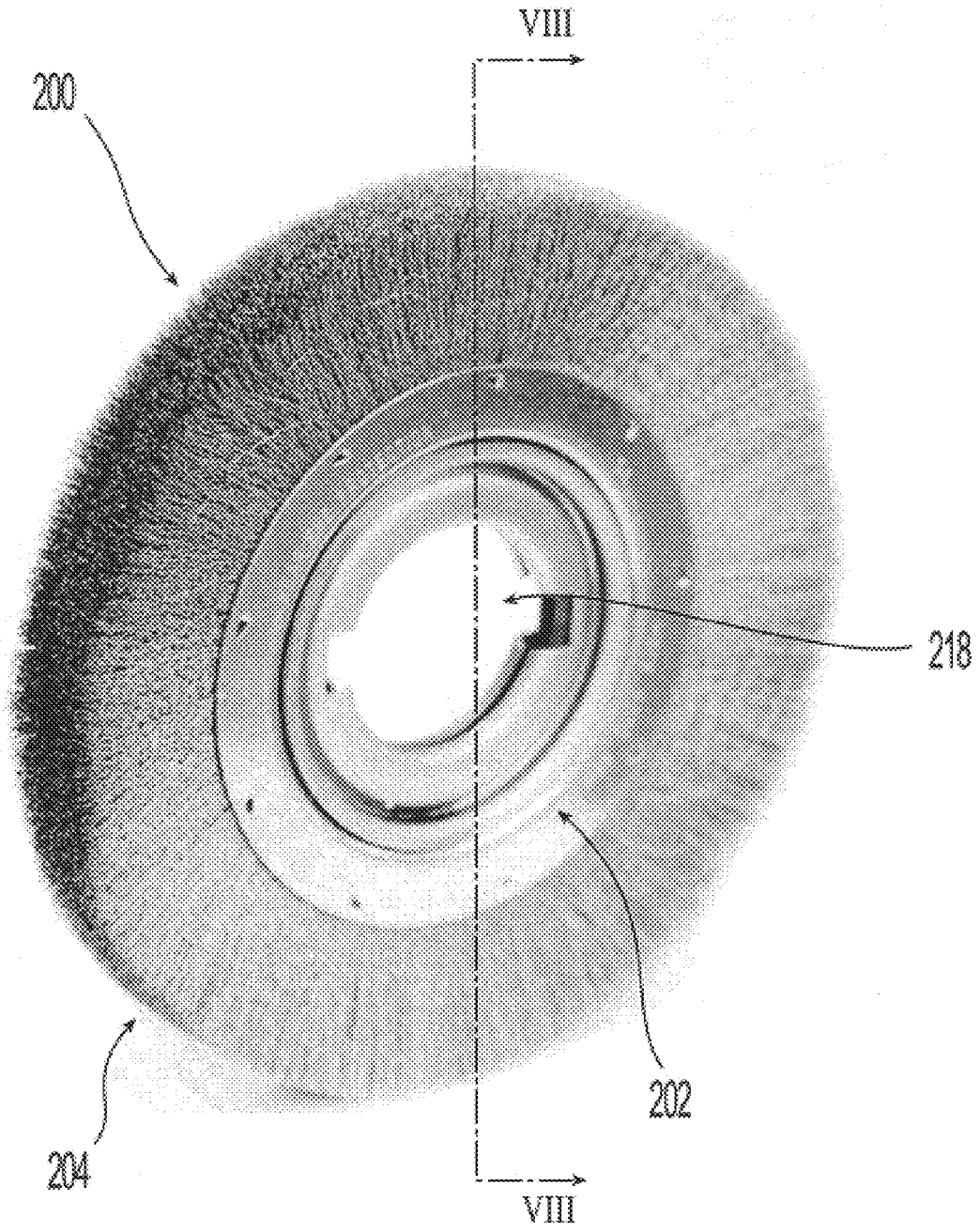
FIG. 7 is a perspective view of an alternate power brush assembly in accordance with the principles of the present invention.
Figure 8:
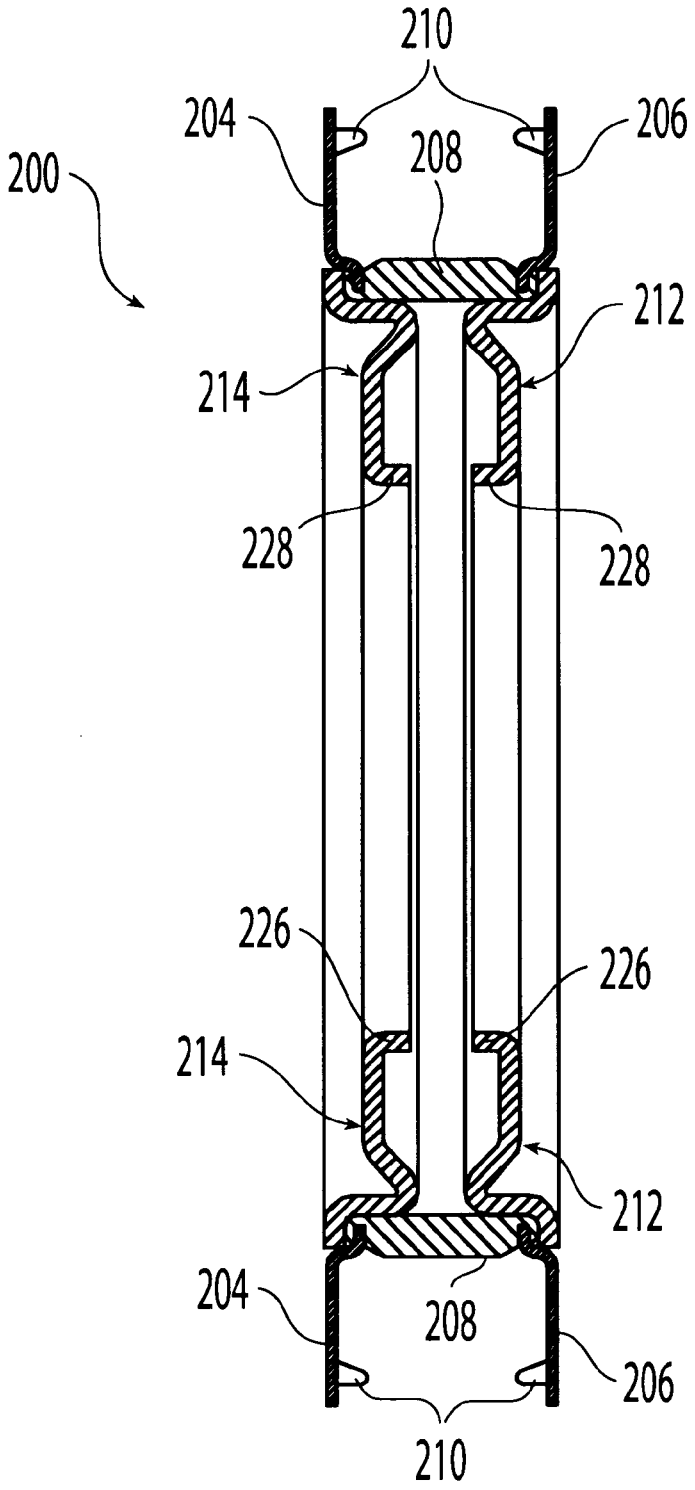
FIG. 8 is cross-sectional view along line VIII—VIII of the hub of the power brush assembly of FIG. 7.

Turning now to FIGS. 7 and 8, in another embodiment, a power brush assembly 200 is shown. Power brush assembly 200 includes a modified hub 202 and filaments 204. Modified hub 202 includes a pair of face plates 204, 206 with an arbor tube 208 disposed therebetween. Spikes 210, which may be stamped from face plates 204, 206, may be provided to bite into filaments held between face plates 204, 206. Modified hub 202 further includes a pair of locking plates 212, 214 that are integrated with arbor tube 208. While face plates 204, 206 are used to retain filaments on power brush assembly 200, as described above with reference to face plates 104, 106 of brush assembly 100, locking plates 212, 214 provide improved mounting of power brush assembly 200 on a drive shaft to provide for positive transmission of torque from the drive shaft to hub 208, as will now be described.

Locking plates 212, 214 together form a key-shaped hole 220. Advantageously, key-shaped hole 218 is configured and dimensioned so that when a shaft and associated key are inserted into hole 218 of hub 202, positive torque transmission from the shaft to power brush assembly 200 occurs. Because of the interlocking of the shaft with key-shaped hole 218, potential slippage between hub 202 and the shaft also is eliminated.

Figure 9:
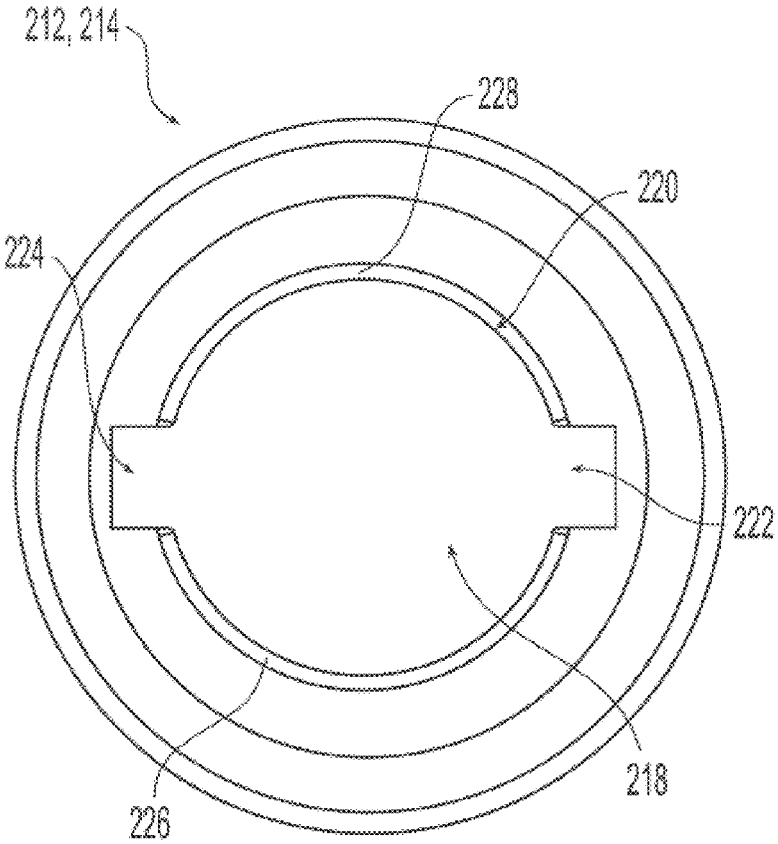
FIG. 9 is an elevational view of a locking plate used in the hub of FIG. 8.

As shown in FIG. 9, hole 218 of exemplary locking plates 212, 214 has a circular portion 220 and two keyseats 222, 224. Preferably, keyseats 222, 224 are rectangular grooves. Alternatively, tapered grooves or other configurations may be used, and a fillet radius and/or chamfer may be included. Inwardly facing lip portions 226, 228 provide additional surface area for contacting a shaft inserted within circular portion 220, conferring some frictional engagement between a shaft and a locking plate 212, 214. The keyseats 222, 224 of a locking plate 212, 214 are configured and dimensioned to receive keys on the drive shaft on which power brush assembly 200 is mounted. The keys may either be formed integrally with the shaft or the shaft may have keyseats configured and dimensioned to receive a key, in a manner known to those of ordinary skill in the art. Thus, positive transmission of torque from a drive shaft to power brush assembly 200 is achievable by the provision of inventive locking plates 212, 214.

Because drive shafts may vary in diameter, it is convenient to form a power brush assembly with a shaft attachment hole large enough for mounting of the power brush assembly on any drive shaft. In accordance with a further aspect of the present invention, adapters may be provided for mounting a power brush assembly on drive shafts having outer diameters smaller than the inner diameter of the shaft mounting hole of power brush assembly 200. In particular, the use of an adapter that is selectively insertable into the shaft mounting hole can facilitate the use of power brush assemblies with a given shaft mounting hole size on smaller-sized shafts.

Figure 10:
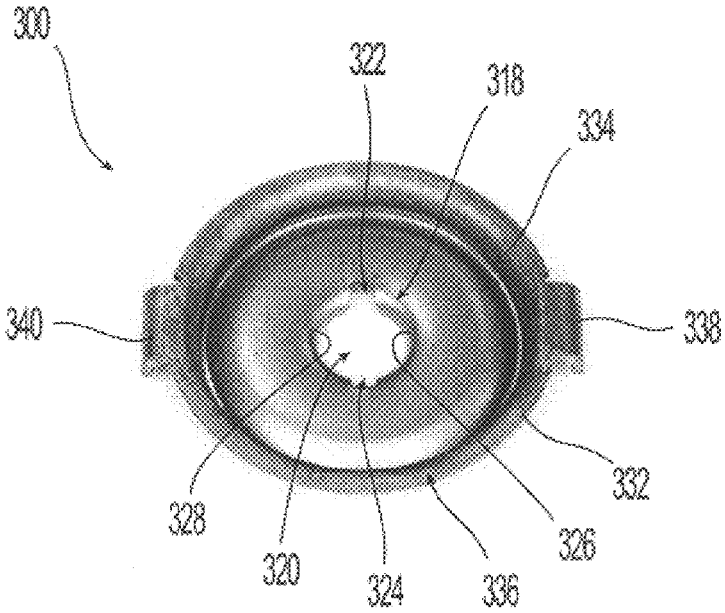
FIG. 10 is a perspective view of an adapter suitable for insertion into a locking plate of FIG. 7.
Figure 11:
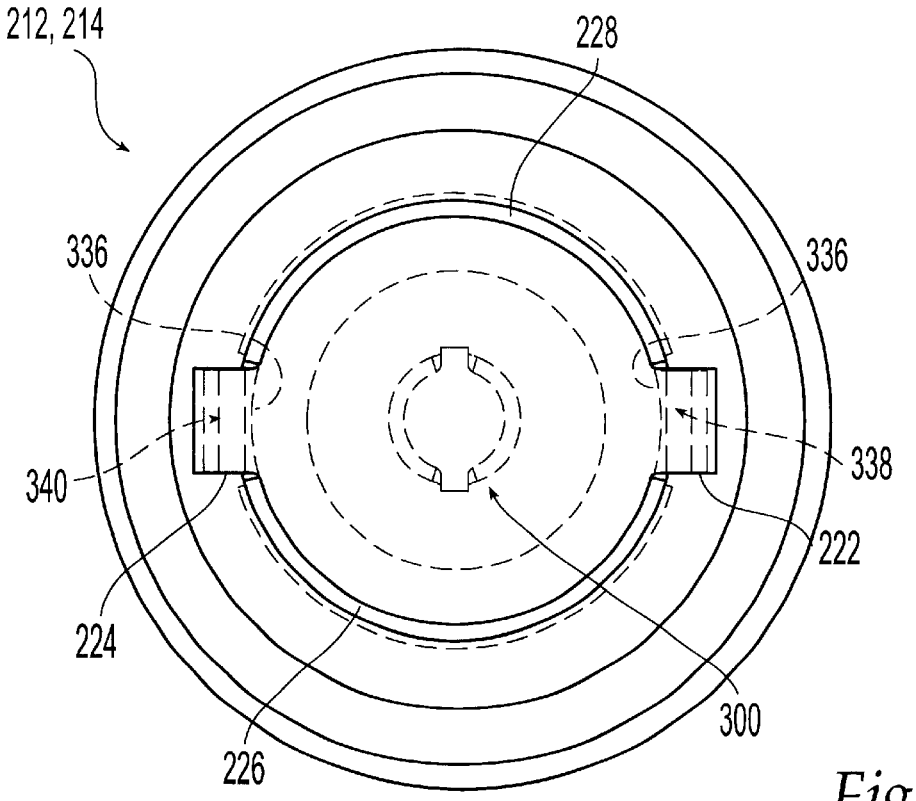
FIG. 11 is an elevational view of a locking plate of FIG. 7 with an adapter shown in phantom inserted therein.
Figure 12:
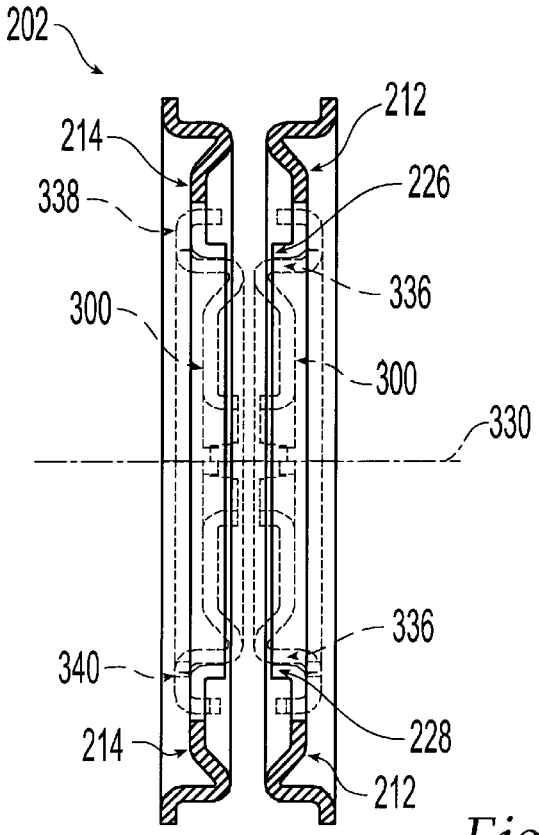
FIG. 12 is a cross-sectional view of an adapter inserted in each of the locking plates of the hub of FIG. 8.

An adapter suitable for providing positive torque transmission from a shaft to the hub of a power brush assembly such as power brush assembly 200 is shown in FIGS. 10–12. Adapter 300 of FIGS. 10–12 includes centrally located shaft mounting hole 320 having a circular portion 318 and two rectangular-shaped keyseats 322, 324. It will be appreciated that other shaft mounting hole configurations, such as configurations with other keyseat-groove geometries, may be used. Inwardly facing lip portions 326, 328 provide additional surface area for contacting a shaft inserted within circular portion 320, conferring frictional engagement between a shaft and adapter 300. In the exemplary embodiment, adapter 300 has an overall dish-shape, with a maximum overall dimension along axis 330 occurring along outer edge 332, the overall width decreasing sharply to an annular groove 334, and then again slightly increasing before flattening toward hole 318. Such a shape provides a rigid construction by creating a high moment of inertia about a plane perpendicular to the mounting shaft, along with a strong radial contact force between the locking plate and the hub. Annular groove 334 permits the adapter with its associated locking plate to function as a spring having a very high compression rate, and there is an elastic reaction between the outside diameter of the adapter with locking plate and the inside diameter of the arbor tube. The region between outer edge 332 and annular groove 334 thus forms a cylindrical wall 336. Exemplary adapter 300 includes wing portions 338, 340 that are disposed preferably symmetrically on the perimeter of adapter 300, and may be L-shaped. Wing portions 338, 340 provide interlocking of adapter 300 with keyseats, such as provided in above-described locking plates 212, 214.

As shown in FIGS. 11 and 12, adapter 300 (shown in phantom) is configured and dimensioned to fit securely within a locking plate 212, 214. When an adapter 300 is inserted into a locking plate 212, 214, wing portions 338, 340 of adapter 300 fit within keyseats 222, 224 of locking plate 212, 214, such as by a press-fit, while cylindrical wall 336 of adapter 300 fits within, such as by a press fit and by abutting against, lip portions 226, 228 of the locking plate 212, 214. Advantageously, mechanical interlocking is provided by the wing portions 338, 340 inserted within keyseats 222, 224, and thus positive, mechanical torque transmission is provided between adapter 300 and the locking plate 212, 214. By press-fitting adapter 300 within a locking plate 212, 214, frictional torque transmission may also be provided. In the embodiment of FIGS. 11–12, two locking plates 212, 214 are used with each power brush assembly 200, and one adapter 300 is used for each locking plate 212, 214.

While the invention has been shown and described herein with reference to particular embodiments, it is to be understood that the various additions, substitutions, or modifications of form, structure, arrangement, proportions, materials, and components and otherwise, used in the practice of the invention and which are particularly adapted to specific environments and operative requirements, may be made to the described embodiment without departing from the spirit and scope of the present invention. For example, the principles of the invention may be applied to brushes having filaments other than wire filaments and for brushes which are not only used in power applications. For instance, brushes using filaments other than wire filaments may also benefit from the above-described inventive brush assembly construction which permits a secure assembly and consistent brush filament density. Brushes which may not be mounted on drive shafts, thus obviating the need for adapters for the above-mentioned usage, still may benefit from the improved brush construction and concomitant improved brush performance achievable with a more consistent brush filament density. In addition, any type of brush to be mounted on a drive shaft may benefit from the adapters of the present invention. It is further noted that other materials may be retained by the improved arbor tube and plate assembly, such as grinding and polishing wheels and discs. Moreover, in order to provide further linkage between the elements of the brush assembly, the spikes provided on opposing face plates may extend between the plates and interlock. In addition, while the adapters shown herein each include two keyseats, a different number of keyseats may be provided. The presently disclosed embodiments are therefore to be considered in all respects as illustrative and not restrictive, the scope of the invention being indicated by the appended claims, and not limited to the foregoing description.

What is claimed is:

1. A hub for supporting and retaining at least one surface conditioning article relative to and spaced apart from a rotary shaft, said hub comprising:

an arbor tube having first and second ends;

a pair of face plates each having an inner rim with a top surface and a bottom surface; and at least one surface conditioning article mounted around said arbor tube and between said face plates;

wherein:

said arbor tube includes a pair of opposing shoulders, a shoulder being disposed at each end of said arbor tube; and said face plates are coupled to said first and second ends of said arbor tube such that said bottom surface of said inner rim abuts said shoulders and said face plates are maintained at a set distance apart by said shoulders.

2. A hub according to claim 1, wherein:

said arbor tube further includes a pair of extensions, each extension extending away from a respective shoulder; and said face plates are mounted on a respective extension.

3. A hub according to claim 2, wherein said extensions are deformed to abut respective top surfaces of said face plates to couple said face plates coupled to said arbor tube.

4. A hub according to claim 1, wherein at least one of said face plates includes at least one spike.

5. A hub according to claim 1, wherein said at least one surface conditioning article includes filaments disposed radially about said outer surface of said arbor tube and when said face plates are coupled to said arbor tube with said bottom surface of each said inner rim abutting a shoulder of said arbor tube, said filaments have a substantially uniform filament density between said face plates.

6. A hub for supporting and retaining at least one surface conditioning article relative to and spaced apart from a rotary shaft, said hub comprising:

an arbor tube having first and second ends; and a pair of face plates each having an inner rim with a top surface and a bottom surface;

wherein:

said arbor tube includes a pair of opposing shoulders, with a shoulder being disposed at each end of said arbor tube, and said shoulders include chamfered portions; and said face plates are coupled to said first and second ends of said arbor tube such that said bottom surface of said inner rim abuts said shoulders and said face plates are maintained at a set distance apart by said shoulders.

7. A brush assembly comprising:

an arbor tube having first and second ends;

a pair of face plates each having an inner rim with a top surface and a bottom surface; and brush filaments mounted around said arbor tube and between said face plates;

wherein:

said arbor tube includes a pair of opposing shoulders, a shoulder being disposed at each end of said arbor tube; and said face plates are coupled to said first and second ends of said arbor tube such that said bottom surface of said inner rim abuts said shoulders and said face plates are maintained at a set distance apart by said shoulders;

whereby said brush filament density is determined by the distance of said face plates from each other as set by the distance of said shoulders on said arbor tube.

8. A brush assembly according to claim 7, wherein:

said brush filaments are formed as a plurality of separate brush sections, each said brush section comprising a retaining ring and a plurality of filaments around said retaining ring; and spacing between said brush sections is set by the distance between said shoulders and the resulting set distance between said face plates.

9. A brush assembly according to claim 7, wherein:

said arbor tube further includes a pair of extensions, each extension extending away from a respective shoulder; and said face plates are mounted on a respective extension.

10. A brush assembly according to claim 9, wherein said extensions are deformed to abut respective top surfaces of said face plates to couple said face plates coupled to said arbor tube.

11. A brush assembly according to claim 7, wherein at least one of said face plates includes at least one spike biting into said brush filaments.

12. A brush assembly according to claim 7, wherein said shoulders include chamfered portions.

13. A hub for supporting and retaining at least one surface conditioning article relative to and spaced apart from a rotary shaft, said hub comprising:

an arbor tube having first and second ends;

a pair of opposing locking plates, a locking plate being mounted on each end of said arbor tube; and at least one surface conditioning article mounted around said arbor tube and between said locking plates;

wherein a key-shaped region is defined in each of said locking plates, said key-shaped region having at least a circular portion and a keyseat.

14. A hub according to claim 13, wherein a pair of opposing keyseats is provided in each key-shaped region.

15. A hub according to claim 13, wherein said keyseat is a rectangular groove.

16. A hub according to claim 13, further including at least one adapter configured and dimensioned to be engaged in said key-shaped region.

17. A hub according to claim 16, wherein said adapter includes an outwardly extending key shaped to engage within said keyseat of said key-shaped region of said locking plate.

18. A hub according to claim 17, wherein:

said locking plate includes a pair of opposing keyseats within said key-shaped region; and said adapter includes a pair of opposing outwardly extending keys shaped to engage within said keyseats of said locking plate key-shaped region.

19. A hub according to claim 17, wherein an adapter key-shaped region is defined in said adapter shaped to accommodate a shaft smaller in diameter than said locking plate key-shaped region and keys mounted on said shaft.

20. A hub for supporting and retaining at least one surface conditioning article relative to and spaced apart from a rotary shaft, said hub comprising:

an arbor tube having first and second ends; and a pair of opposing locking plates, a locking plate being mounted on each end of said arbor tube;

wherein a key-shaped region is defined in each of said locking plates, said key-shaped region having at least a circular portion and a keyseat, and a lip is provided in said circular portion of said key-shaped region.

21. A method for positively driving a power brush, comprising:

providing a hub comprising an arbor tube having first and second ends, and a pair of opposing locking plates, a locking plate being mounted on each end of said arbor tube, at least one of said locking plates having at least one key-shaped region having at least a circular portion and a plate keyseat;

providing a rotary shaft, said shaft having at least one shaft keyseat; and inserting a key in said shaft keyseat and said locking plate keyseat, thereby coupling said shaft to said hub.

22. A method for positively driving a power brush, comprising:

providing a hub comprising an arbor tube having first and second ends, and a pair of opposing locking plates, a locking plate being mounted on each end of said arbor tube, with at least one of said locking plates having at least one plate key-shaped region having at least a circular portion and a plate keyseat;

adapting said locking plate for mounting on a drive shaft having a smaller shaft diameter than said circular portion of said key-shaped region of said locking plate, said adapting accomplished by mounting an adapter in said key-shaped region, said adapter including an adapter key-shaped region having at least a circular portion and an adapter keyseat;

providing a rotary shaft, said shaft having at least one shaft keyseat; and inserting a key in said shaft keyseat and said adapter keyseat, thereby coupling said shaft to said adapter.

* * * * *